US009478869B1

(12) United States Patent
Zhu et al.

(10) Patent No.: US 9,478,869 B1
(45) Date of Patent: Oct. 25, 2016

(54) ELECTRONIC DEVICES WITH HYBRID PATCH AND MONOPOLE ANTENNA FOR HIGH ALTITUDE PLATFORM APPLICATION

(71) Applicant: Google Inc., Mountain View, CA (US)

(72) Inventors: Jiang Zhu, Cupertino, CA (US); Cyrus Behroozi, Menlo Park, CA (US)

(73) Assignee: GOOGLE INC., Mountain View, CA (US)

( * ) Notice: Subject to any disclaimer, the term of this patent is extended or adjusted under 35 U.S.C. 154(b) by 78 days.

(21) Appl. No.: 14/584,610

(22) Filed: Dec. 29, 2014

(51) Int. Cl.

| | |
|---|---|
| ***H01Q 1/38*** | (2006.01) |
| ***H01Q 19/00*** | (2006.01) |
| ***H01Q 19/10*** | (2006.01) |
| ***H01Q 5/385*** | (2015.01) |
| ***H01Q 5/30*** | (2015.01) |
| ***H01Q 5/378*** | (2015.01) |

(52) U.S. Cl.
CPC ..... *H01Q 19/005* (2013.01); *H01Q 5/30* (2015.01); *H01Q 5/378* (2015.01); *H01Q 5/385* (2015.01); *H01Q 19/10* (2013.01)

(58) Field of Classification Search
CPC ..... H01Q 1/38; H01Q 9/04; H01Q 5/30; H01Q 5/378; H01Q 5/385
USPC ..... 343/700 MS
See application file for complete search history.

(56) References Cited

U.S. PATENT DOCUMENTS

| | | | | |
|---|---|---|---|---|
| 6,909,400 | B2 | 6/2005 | Vothknecht et al. | |
| 7,196,666 | B2 * | 3/2007 | Allen | H01Q 9/0407 343/700 MS |
| 8,373,597 | B2 * | 2/2013 | Schadler | H01Q 1/42 343/700 MS |
| 8,854,266 | B2 | 10/2014 | Zhu et al. | |
| 2014/0266932 | A1 | 9/2014 | Schmidt et al. | |
| 2014/0306857 | A1 | 10/2014 | Bevelacqua et al. | |

FOREIGN PATENT DOCUMENTS

WO WO 2012/110098 A1 8/2012

* cited by examiner

*Primary Examiner* — Hoang V Nguyen
(74) *Attorney, Agent, or Firm* — McDonnell Boehnen Hulbert and Berghoff LLP

(57) ABSTRACT

This disclosure relates to an antenna system. The antenna system includes a first radiating element configured to emit electromagnetic radiation based on a first input signal. The antenna system also includes a reflecting element configured to reflect at least a portion of the electromagnetic radiation emitted by the first radiating element. The antenna system further includes a ground plane located between the first radiating element and the reflecting elements. Additionally, the antenna system has a feed configured to provide the input signal to the first radiating element. Furthermore, the antenna system includes at least one metallic support structure. The metallic support structure is configured to both (i) provide a separation between the first radiating element and the reflecting element and (ii) radiate electromagnetic energy based on a coupling of the electromagnetic radiation emitted by the first radiating element.

18 Claims, 11 Drawing Sheets

ELECTRONIC DEVICES WITH HYBRID PATCH AND MONOPOLE ANTENNA FOR HIGH ALTITUDE PLATFORM APPLICATION

BACKGROUND

Computing devices such as personal computers, laptop computers, tablet computers, cellular phones, and countless types of Internet-capable devices are increasingly prevalent in numerous aspects of modern life. As such, the demand for data connectivity via the Internet, cellular data networks, and other such networks, is growing. However, there are many areas of the world where data connectivity is still unavailable, or if available, is unreliable and/or costly. Accordingly, additional network infrastructure is desirable.

SUMMARY

In order to communicate between a ground-based system and the balloons, both the ground based system and the balloons will have antennas. The antennas are configured to both radiate and receive electromagnetic energy. Unlike networks with fixed infrastructure, the present balloon-based network features both ground-based and balloon-based components that may be able to move with respect to each other. Therefore, the presently disclosed antenna system and methods help enable communication between ground-based and balloon-based components of a network. The presently disclosed antenna system may enable the communication system to communicate over a wider range of angles than other antenna systems. By enabling communications over a wider range of angles, the presently disclosed antenna system may increase the reliability of a balloon to ground communication link.

In one aspect, an antenna system is disclosed. The antenna system includes a first radiating element configured to emit electromagnetic radiation based on a first input signal. The antenna system also includes a reflecting element configured to reflect at least a portion of the electromagnetic radiation emitted by the first radiating element. The antenna system further includes a ground plane located between the first radiating element and the reflecting elements. Additionally, the antenna system has a feed configured to provide the input signal to the first radiating element. Furthermore, the antenna system includes at least one metallic support structure. The metallic support structure is configured to (i) provide a separation between the first radiating element and the reflecting element, (ii) receive electromagnetic radiation emitted by the first radiating element based on at least a portion of the electromagnetic radiation emitted by the first radiating element coupling to the at least one metallic support structure, and (iii) radiate electromagnetic energy based on the received electromagnetic radiation.

In a second aspect, a method of radiating electromagnetic energy is disclosed. The method includes feeding a first input signal to a first radiating element. The method further includes radiating a signal based on at least a portion of the input signal by the first radiating element. The method also includes supporting the first radiating element above a reflecting element with at least one metallic support structure. Additionally, the method includes receiving, by the at least one metallic support structure, electromagnetic radiation emitted by the first radiating element based on at least a portion of the electromagnetic radiation emitted by the first radiating element coupling to the at least one metallic support structure. Further, the method includes radiating electromagnetic energy with the at least one metallic support structure based on the received electromagnetic radiation. Furthermore, the method includes reflecting a portion of at least one of (i) the signal radiated by the first radiating element, and (ii) electromagnetic energy radiating by the at least one metallic support structure, with the reflecting element.

In a third aspect, the present disclosure features an apparatus including a means for radiating electromagnetic energy. The apparatus includes means for feeding a first input signal to a first radiating element. The apparatus further includes means for radiating a signal based on at least a portion of the input signal. The apparatus also includes means for supporting the means for radiating above a means for reflecting with at least one means for support. Additionally, the apparatus includes means for radiating electromagnetic energy with the at least one metallic support structure based on a coupling of the signal radiated by the first radiating element. Furthermore, the apparatus includes means for reflecting a portion of at least one of (i) the signal radiated by the means for radiating, and (ii) electromagnetic energy radiating by the at least one means for supporting, with the means for reflecting.

DETAILED DESCRIPTION

I. Overview

Figure 1:
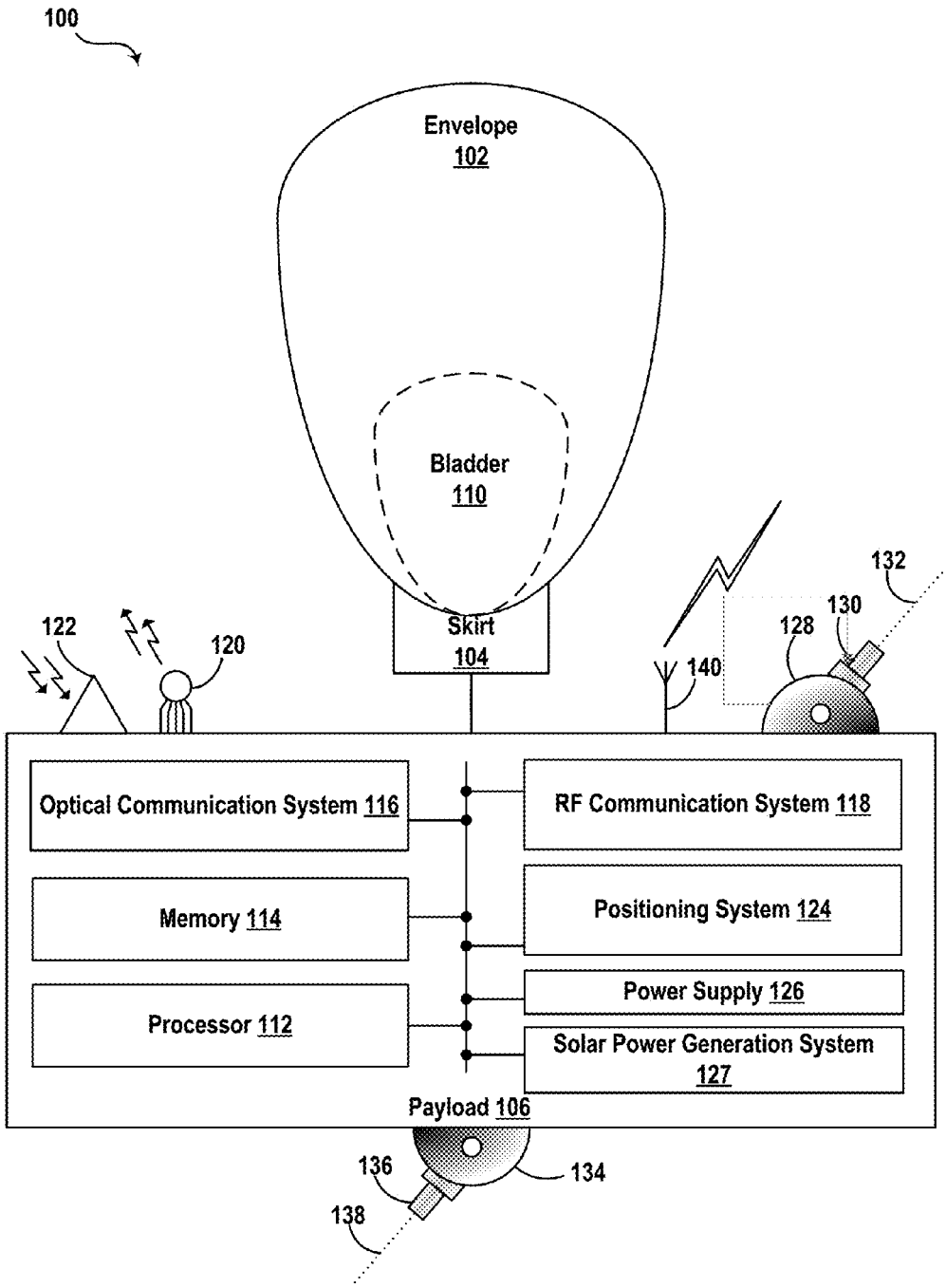
FIG. 1 illustrates a high-altitude balloon, according to an embodiment.

Illustrative embodiments can be implemented as an apparatus including a hybrid patch and monopole antenna for radiation pattern control of a super pressure aerostatic balloon with a data network of balloons, such as, for example, a mesh network of high-altitude balloons deployed in the stratosphere. The apparatus may include a hybrid patch and monopole antenna for radiation pattern control that can allow both the balloon and ground-based computing system to communicate over a larger range of angles, in situations when the balloon network is needed or desired to supplement a cellular network, among other situations. The disclosed antenna design may be used on the balloon, on the ground-based receiving device, or both. The balloon network can be useful for supplementing the cellular network in various scenarios. For example, the balloon network can be a useful supplement when the cellular network has reached capacity. As another example, the balloon network can be a useful supplement when the cellular network provides insufficient coverage in a given area.

By combining both a patch element with at least one monopole antenna, an antenna unit may be created that has a radiation pattern that is desirable for communications, such as balloon-to-ground communications. A patch antenna has a radiation pattern that primarily radiates energy in the direction normal to the surface of the patch. Similarly, a monopole antenna has a radiation pattern that primarily radiates energy in the direction perpendicular to the length (i.e. orientation) of the monopole. Therefore, when at least one monopole antenna is used to support a patch antenna above a surface, the radiation pattern of the monopole and the patch may be aligned approximately orthogonally.

In one example embodiment, the patch antenna may be driven with at least one feed signal. When the patch receives the feed signal, it radiates at least a portion of the feed signal as electromagnetic radiation. A portion of this electromagnetic radiation may be received (i.e. couple into) by the monopole antenna acting as the support. The monopole may, in turn, re-radiate at least a portion of the received electromagnetic radiation. Thus, because both the at least one monopole antenna and the patch antenna may provide simultaneous radiation signals, each having a radiation pattern associated with the respective radiating antenna, the far-field radiation pattern may be equal to the sum of the radiation pattern of the patch antenna and the at least one monopole antenna.

Based on the size, shape, and location of the at least one monopole antenna with respect to the patch the amount of electromagnetic radiation that couples into the monopole antenna (and therefore radiated by the monopole antenna) may be adjusted. By adjusting the coupling the far-field radiation pattern may be controlled. In various embodiments, the far-field radiation pattern may be adjusted in a way to allow communications in a balloon-to-ground communication system to function over a wide range of angles between the balloon and the ground-based receiver. In a further embodiment, the far-field radiation pattern may be adjusted in a way to compensate for a weaker received signal when the balloon is not directly over the ground-based receiver. In other embodiments, different far-field radiation patterns may be created based on a design criteria.

Disclosed herein are methods and apparatuses that include a hybrid patch and monopole antenna for radiation pattern control that may form a portion of a communication network. However, this disclosure is not limited to a network of balloons and similar methods and apparatuses. The disclosed methods and apparatuses may also function with a single balloon, a high-altitude platform, or other variable-buoyancy vehicles, such as submarines.

II. Balloon Configuration

FIG. 1 illustrates a high-altitude balloon 100, according to an embodiment. The balloon 100 includes an envelope 102, a skirt 104, and a payload 106.

The envelope 102 and the skirt 104 can take various forms, which can be currently well-known or yet to be developed. For instance, the envelope 102, the skirt 104, or both can be made of metalized Mylar® or BoPET (biaxially-oriented polyethylene terephthalate). Some or all of the envelope 102, the skirt 104, or both can be constructed from a highly-flexible latex material or a rubber material, such as, for example, chloroprene. These examples are illustrative only; other materials can be used as well. Further, the shape and size of the envelope 102 and the skirt 104 can vary depending upon the particular implementation. Additionally, the envelope 102 can be filled with various different types of gases, such as, for example, helium, hydrogen, or both. These examples are illustrative only; other types of gases can be used as well.

The payload 106 of the balloon 100 includes a processor 112 and memory 114. The memory 114 can be or include a non-transitory computer-readable medium. The non-transitory computer-readable medium can have instructions stored thereon, which can be accessed and executed by the processor 112 in order to carry out some or all of the functions provided in this disclosure.

The payload 106 of the balloon 100 can also include various other types of equipment and systems to provide a number of different functions. For example, the payload 106 includes an optical communication system 116. The optical communication system 116 can transmit optical signals by way of an ultra-bright LED system 120. In addition, the optical communication system 116 can receive optical signals by way of an optical-communication receiver, such as, for example, a photo-diode receiver system. Further, the payload 106 can include an RF communication system 118. The RF communication system 118 can transmit and/or receive RF communications by way of an antenna system 140.

In addition, the payload 106 includes a power supply 126. The power supply 126 can be used to provide power to the various components of the balloon 100. The power supply 126 can be or include a rechargeable battery. In some implementations, the power supply 126 can represent another suitable power supply known in the art for producing power. In addition, the balloon 100 includes a solar power generation system 127. The solar power generation system 127 can include solar panels, which can be used to generate power for charging the power supply 126 or for distribution by the power supply 126. In some embodiments, it may be desirable for the balloon system to run off sustainable power. Therefore, all energy used by the balloon system from power supply 126 may be provided from a renewable source, such as solar power generation system 127.

Further, the payload 106 includes various types of sensors 128. The payload 106 can include sensors such as, for example, video or still cameras, a GPS system, motion sensors, accelerometers, gyroscopes, compasses, or sensors for capturing environmental data. These examples are illustrative only; the payload 106 can include various other types of sensors. Further, some or all of the components in the payload 106 can be implemented in a radiosonde, which can be operable to measure various types of information, such as, for example, pressure, altitude, geographical position (latitude and longitude), temperature, relative humidity, wind speed, or direction, among other information.

As noted above, the payload 106 includes an ultra-bright LED system 120. In some implementations, the ultra-bright LED system 120 can be used for free-space optical communication with other balloons. In some implementations, the ultra-bright LED system 120 can be used for free-space optical communication with satellites. In some implementations, the ultra-bright LED system 120 can be used for free-space optical communication both with other balloons and with satellites. To this end, the optical communication system 116 can be configured to transmit a free-space optical signal by causing modulations in the ultra-bright LED system 120. The manner in which the optical communication system 116 is implemented can vary, depending upon the particular application.

In addition, the balloon 100 can be configured for altitude control. For instance, the balloon 100 can include a variable buoyancy system. The buoyancy system can be configured to change the altitude of the balloon 100 by adjusting the volume, the density, or both of the gas in the envelope 102 of the balloon 100. A variable buoyancy system can take various forms, and can generally be any system that can change the volume and/or density of gas in the envelope 102 of the balloon 100.

In an embodiment, a variable buoyancy system can include a bladder 110 that is located inside of the envelope 102. The bladder 110 can be an elastic chamber that is configured to hold liquid and/or gas. Alternatively, the bladder 110 need not be inside the envelope 102. For instance, the bladder 110 can be a rigid bladder that can be pressurized well beyond neutral pressure. The buoyancy of the balloon 100 can therefore be adjusted by changing the density and/or volume of the gas in the bladder 110. To change the density in the bladder 110, the balloon 100 can be configured with systems and/or mechanisms for heating and/or cooling the gas in the bladder 110. Further, to change the volume, the balloon 100 can include pumps or other features for adding gas to and/or removing gas from the bladder 110. To change the volume of the bladder 110, the balloon 100 can include release valves or other features that are controllable to allow gas to escape from the bladder 110. Multiple bladders 110 can be implemented within the scope of this disclosure. For instance, multiple bladders can be used to improve balloon stability.

In an embodiment, the envelope 102 can be filled with helium, hydrogen, or other material that is lighter than air. Thus, the envelope 102 can have an associated upward buoyancy force. In this embodiment, air in the bladder 110 can be considered a ballast tank that can have an associated downward ballast force. In another embodiment, the amount of air in the bladder 110 can be changed by pumping air (for example, with an air compressor) into and out of the bladder 110. By adjusting the amount of air in the bladder 110, the ballast force can be controlled. In some embodiments, the ballast force can be used, in part, to counteract the buoyancy force and/or to provide altitude stability.

In some embodiments, the envelope 102 can be substantially rigid and include an enclosed volume. Air can be evacuated from the envelope 102 while the enclosed volume is substantially maintained. In other words, at least a partial vacuum can be created and maintained within the enclosed volume. Thus, the envelope 102 and the enclosed volume can become lighter than air and provide a buoyancy force. In some embodiments, air or another material can be controllably introduced into the partial vacuum of the enclosed volume by a control unit in an effort to adjust the overall buoyancy force and/or to provide altitude control. Further, the envelope 102 may be coupled to a mass-changing unit, configured to function as the control unit. The mass-changing unit may be configured with an impeller configured to add or remove air from within the envelope 102. Additionally, the mass-changing unit may also include a vent configured to add or remove air from the envelope 102. A more detailed description of the altitude control system is described with respect to FIG. 5 herein.

In an embodiment, a portion of the envelope 102 can be a first color (for example, black) and/or a first material that is different from another portion or the remainder of the envelope 102. The other portion or the remainder of the envelope can have a second color (for example, white) and/or a second material. For instance, the first color and/or first material can be configured to absorb a relatively larger amount of solar energy than the second color and/or second material. Thus, rotating the balloon such that the first material is facing the sun can act to heat the envelope 102 as well as the gas inside the envelope 102. In this way, the buoyancy force of the envelope 102 can increase. By rotating the balloon such that the second material is facing the sun, the temperature of gas inside the envelope 102 can decrease. Accordingly, the buoyancy force can decrease. In this manner, the buoyancy force of the balloon can be adjusted by changing the temperature/volume of gas inside the envelope 102 using solar energy. In this embodiment, a bladder need not be an element of the balloon 100. Thus, in this embodiment, altitude control of the balloon 100 can be achieved, at least in part, by adjusting the rotation of the balloon 100 with respect to the sun.

Further, the payload 106 of the balloon 100 can include a navigation system (not shown in FIG. 1). The navigation system can implement station-keeping functions to maintain position within and/or move to a position in accordance with a desired topology. In particular, the navigation system can use altitudinal wind data to determine altitudinal adjustments that result in the wind carrying the balloon in a desired direction and/or to a desired location. The altitude-control system can then make adjustments to the density of the balloon chamber in order to effectuate the determined altitudinal adjustments and cause the balloon to move laterally to the desired direction and/or to the desired location.

Alternatively, the altitudinal adjustments can be computed by a ground-based control system and communicated to the high-altitude balloon. As another alternative, the altitudinal adjustments can be computed by a ground-based or satellite-based control system and communicated to the high-altitude balloon. Furthermore, in some embodiments, specific balloons in a heterogeneous balloon network can be configured to compute altitudinal adjustments for other balloons and transmit the adjustment commands to those other balloons.

In such an arrangement, the navigation system can be operable to navigate the balloon to a landing location, in the event the balloon needs to be removed from the network and/or accessed on the ground. Further, a balloon can be self-sustaining so that it does not need to be accessed on the ground. In some embodiments, a balloon can be serviced in-flight by one or more service balloons or by another type of service aerostat or service aircraft.

III. Balloon Networks

Figure 2:
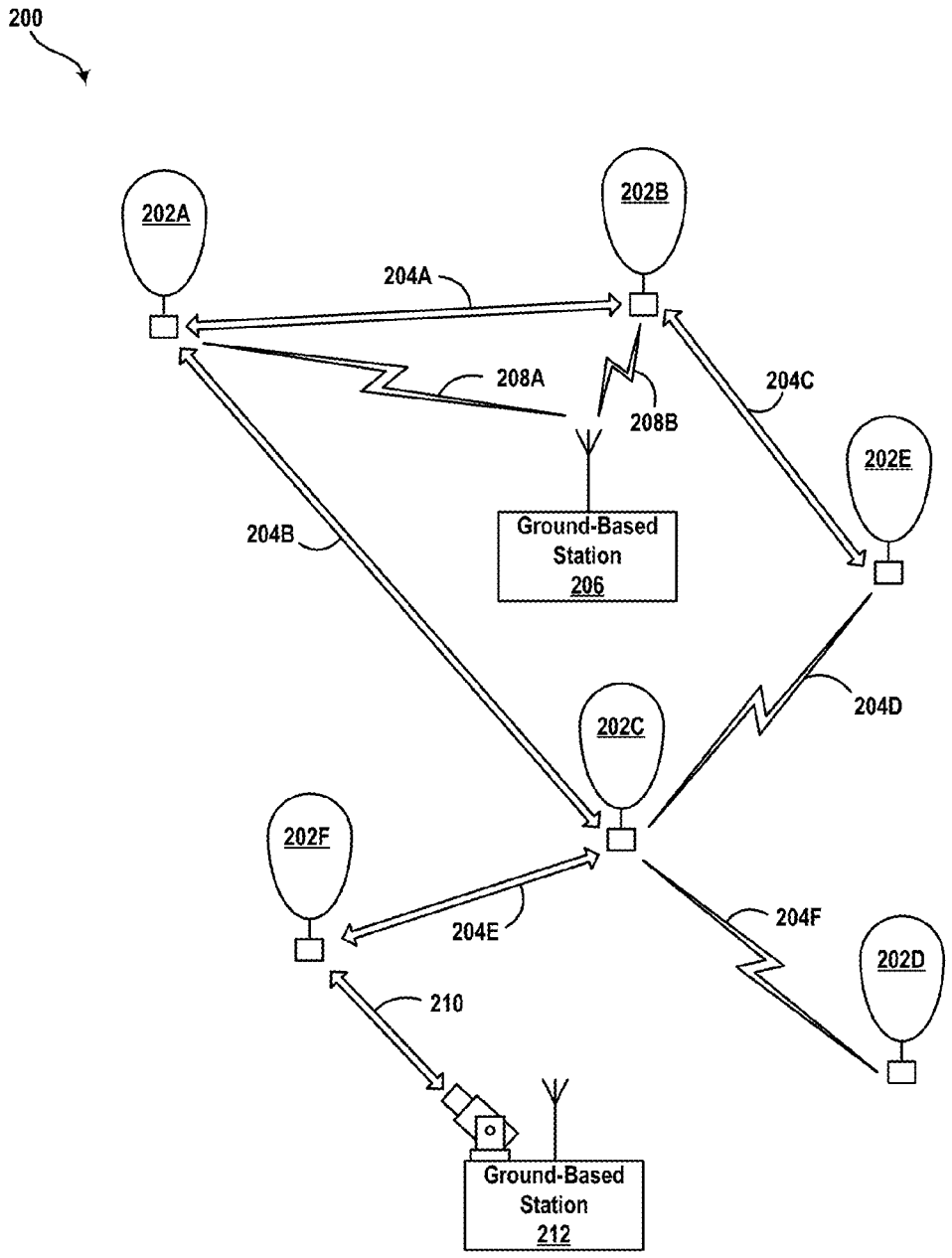
FIG. 2 illustrates a balloon network, according to an embodiment.

FIG. 2 illustrates a balloon network 200, according to an embodiment. The balloon network 200 includes balloons 202A-202F. The balloons 202A-202F are configured to communicate with one another by way of free-space optical links 204A-204F. Configured as such, the balloons 202A to 202F can collectively function as a mesh network for packet-data communications. Further, at least some of the balloons 202A-202F, such as, for example, the balloons 202A and 202B, can be configured for RF communications with a ground-based station 206 by way of respective RF links 208A and 208B. The ground-based station 206 represents one or more ground-based stations. In addition, some of the balloons 202A-202F, such as, for example, the balloon 202F, can be configured to communicate by way of an optical link 210 with a ground-based station 212. The ground-based station 212 represents one or more ground-based stations.

In an embodiment, the balloons 202A-202F are high-altitude balloons, which can be deployed in the stratosphere. At moderate latitudes, the stratosphere includes altitudes between approximately 10 kilometers (km) and 50 km above the Earth's surface. At the poles, the stratosphere starts at an altitude of approximately 8 km. In an embodiment, high-altitude balloons can be configured to operate in an altitude range within the stratosphere that has relatively low wind-speeds, such as, for example, between 5 and 20 miles per hour (mph).

In the high-altitude-balloon network 200, the balloons 202A-202F can be configured to operate at altitudes between 18 km and 25 km. In some implementations, the balloons 202A-202F can be configured to operate at other altitudes. The altitude range of 18 km-25 km can be advantageous for several reasons. In particular, this layer of the stratosphere generally has relatively low wind speeds (for example, winds between 5 and 20 mph) and relatively little turbulence. Further, while the winds in this altitude range can vary with latitude and by season, the variations can be modeled in a reasonably accurate manner. In addition, altitudes above 18 km are typically above the maximum flight level designated for commercial air traffic. Therefore, interference with commercial flights is not a significant concern when balloons are deployed between 18 km and 25 km.

To transmit data to another balloon, a given balloon 202A-202F can be configured to transmit an optical signal by way of a corresponding optical link 204A-204F. In an embodiment, some or all of the balloons 202A-202F can use one or more high-power light-emitting diodes (LEDs) to transmit an optical signal. Alternatively, some or all of the balloons 202A-202F can include laser systems for free-space optical communications over corresponding optical links 204A-204F. Other types of free-space optical communication are possible. Further, in order to receive an optical signal from another balloon by way of an optical link, a given balloon 202A-202F can include one or more optical receivers, as discussed above in connection with FIG. 1.

The balloons 202A-202F can utilize one or more of various different RF air-interface protocols for communication with ground-based stations, such as, for example, the ground-based station 206. For instance, some or all of the balloons 202A-202F can be configured to communicate with the ground-based station 206 using protocols described in IEEE 802.11 (including any of the IEEE 802.11 revisions), various cellular protocols such as GSM, CDMA, UMTS, EV-DO, WiMAX, and/or LTE, and/or one or more propriety protocols developed for balloon-ground RF communication, among other possibilities.

There can be scenarios where the RF links 208A-208B do not provide a desired link capacity for balloon-ground communications. For instance, increased capacity can be desirable to provide backhaul links from a ground-based gateway. Accordingly, a balloon network can also include downlink balloons, which can provide a high-capacity air-ground link.

For example, in the balloon network 200, the balloon 202F is configured as a downlink balloon. Like other balloons in the balloon network 200, the downlink balloon 202F can be operable for optical communication with other balloons by way of corresponding optical links 204A-204F. The downlink balloon 202F can also be configured for free-space optical communication with the ground-based station 212 by way of the optical link 210. The optical link 210 can therefore serve as a high-capacity link (as compared to the RF links 208A-208B) between the balloon network 200 and the ground-based station 212.

Note that in some implementations, the downlink balloon 202F can be operable for RF communication with the ground-based stations 206. In other implementations, the downlink balloon 202F may only use the optical link 210 for balloon-to-ground communications. Further, while the arrangement shown in FIG. 2 includes one downlink balloon 202F, a balloon network can also include multiple downlink balloons. In addition, a balloon network can be implemented without the use of any downlink balloons.

In some implementations, a downlink balloon can be equipped with a specialized, high-bandwidth RF communication system for balloon-to-ground communications, instead of, or in addition to, a free-space optical communication system. The high-bandwidth RF communication system can take the form of an ultra-wideband system, which can provide an RF link with substantially the same capacity as one of the optical links 204A-204F.

Ground-based stations, such as the ground-based stations 206 and 212, can take various forms. Generally, a ground-based station includes components such as transceivers, transmitters, and receivers for communication with a balloon network by way of RF links, optical links, or both. Further, a ground-based station can use various air-interface protocols in order to communicate with one or more of the balloons 202A-202F by way of an RF link. As such, a ground-based station 206 can be configured as an access point by which various devices can connect to the balloon network 200. The ground-based station 206 can have other configurations and can serve other purposes without departing from the scope of this disclosure.

Some or all of the balloons 202A-202F can be configured to establish a communication link with space-based satellites by way of corresponding communication links. The balloons can establish the communication links with the space-based satellites in addition to, or as an alternative to, the ground-based communication links. In addition, the balloons can be configured to communicate with the space-based satellites using any suitable protocol. In some implementations, one or more of the communication links can be optical links. Accordingly, one or more of the balloons can communicate with the satellites by way of free-space optical communication. Other balloon-satellite communication links and techniques can be used.

Further, some ground-based stations, such as, for example, the ground-based station 206, can be configured as gateways between the balloon network 200 and another network. For example, the ground-based station 206 can serve as an interface between the balloon network 200 and the Internet, a cellular service provider's network, or another network.

A. Mesh-Network Functionality

As noted above, the balloons 202A-202F can collectively function as a mesh network. More specifically, because the balloons 202A-202F can communicate with one another using free-space optical links, the balloons can collectively function as a free-space optical mesh network.

In a mesh-network configuration, each of the balloons 202A-202F can function as a node of the mesh network. The mesh network can be operable to receive data directed to it and to route data to other balloons. As such, data can be routed from a source balloon to a destination balloon by determining an appropriate sequence of optical links between the source balloon and the destination balloon. This disclosure may refer to these optical links, collectively, as a "lightpath" for the connection between the source and destination balloons. Further, this disclosure may refer to each of the optical links as a "hop" along the lightpath.

To operate as a mesh network, the balloons 202A-202F can employ various routing techniques and self-healing algorithms. In some implementations, the balloon network 200 can employ adaptive or dynamic routing, in which a lightpath between a source balloon and a destination balloon is determined and set-up when the connection is needed, and is released at a later time. Further, when adaptive routing is used, the lightpath can be determined dynamically, depending upon the current state, past state, and/or predicted state of the balloon network.

In addition, the network topology can change as the balloons 202A-202F move relative to one another and/or relative to the ground. Accordingly, the balloon network 200 can apply a mesh protocol to update the state of the network as the topology of the network changes. For example, to address the mobility of the balloons 202A-202F, the balloon network 200 can employ and/or adapt various techniques that are employed in mobile ad hoc networks (MANETs).

In some implementations, the balloon network 200 can be configured as a transparent mesh network. In a transparent balloon network, the balloons can include components for physical switching in a way that is entirely optical, without involving a substantial number of, or any, electrical components in the physical routing of optical signals. Accordingly, in a transparent configuration with optical switching, signals can travel through a multi-hop lightpath that is entirely optical.

In other implementations, the balloon network 200 can implement a free-space optical mesh network that is opaque. In an opaque configuration, some or all of the balloons 202A-202F can implement optical-electrical-optical (OEO) switching. For example, some or all of the balloons 202A-202F can include optical cross-connects (OXCs) for OEO conversion of optical signals. This example is illustrative only; other opaque configurations can be used.

The balloons 202A-202F in the balloon network 200 can utilize techniques such as wavelength division multiplexing (WDM) in order to increase link capacity. When WDM is implemented with transparent switching, physical lightpaths through the balloon network can be subject to the wavelength continuity constraint. In particular, because switching in a transparent network is entirely optical, it can be necessary, in some instances, to assign the same wavelength to all optical links along a given lightpath.

An opaque configuration can be used to avoid the wavelength continuity constraint. In particular, balloons in an opaque balloon network can include OEO switching systems operable for wavelength conversion. As a result, balloons can convert the wavelength of an optical signal at corresponding hops along a lightpath.

Further, various routing algorithms can be employed in an opaque configuration. For example, to determine a primary lightpath and/or one or more diverse backup lightpaths for a given connection, a balloon can apply shortest-path routing techniques, such as, for example, Dijkstra's algorithm and k-shortest path. In addition, a balloon can apply edge and node-diverse or disjoint routing, such as, for example, Suurballe's algorithm. Further, a technique for maintaining a particular quality of service (QoS) can be employed when determining a lightpath.

B. Station-Keeping Functionality

In an embodiment, a balloon network 100 can implement station-keeping functions to help provide a desired network topology. For example, station-keeping can involve each of the balloons 202A-202F maintaining a position or moving to a position relative to one or more other balloons in the network 200. The station-keeping can also, or instead, involve each of the balloons 202A-202F maintaining a position or moving to a position relative to the ground. Each of the balloons 202A-202F can implement station-keeping functions to determine the given balloon's desired positioning in the desired topology, and if desirable, to determine how the given balloon is to move to the desired position.

The network topology can vary depending on the desired implementation. In an implementation, the balloons 202A-202F can implement station-keeping such that the balloon network 200 has a substantially uniform topology. For example, a given balloon can implement station-keeping functions to position itself at substantially the same distance (or within a certain range of distances) from adjacent balloons in the balloon network. In another implementation, the balloons 202A-202F can implement station-keeping such that the balloon network 200 has a substantially non-uniform topology. This implementation can be useful when there is a need for balloons to be distributed more densely in some areas than in others. For example, to help meet higher bandwidth demands that are typical in urban areas, balloons can be clustered more densely over urban areas than in other areas. For similar reasons, the distribution of balloons can be denser over land than over large bodies of water. These examples are illustrative only; non-uniform topologies can be used in other settings.

In addition, the topology of a balloon network can be adaptable. In particular, balloons can utilize station-keeping functionality to allow the balloons to adjust their respective positioning in accordance with a change in the topology of the network. For example, several balloons can move to new positions in order to change a balloon density in a given area.

In an implementation, the balloon network 200 can employ an energy function to determine whether balloons should move in order to provide a desired topology. In addition, the energy function can indicate how the balloons should move in order to provide the desired topology. In particular, a state of a given balloon and states of some or all nearby balloons can be used as inputs to an energy function. The energy function can apply the states to a desired network state, which can be a state corresponding to the desired topology. A vector indicating a desired movement of the given balloon can then be determined by determining a gradient of the energy function. The given balloon can then determine appropriate actions to take in order to effectuate the desired movement. For example, a balloon can determine an altitude adjustment or adjustments such that winds will move the balloon in the desired manner.

C. Control of Balloons in a Balloon Network

Figure 3:
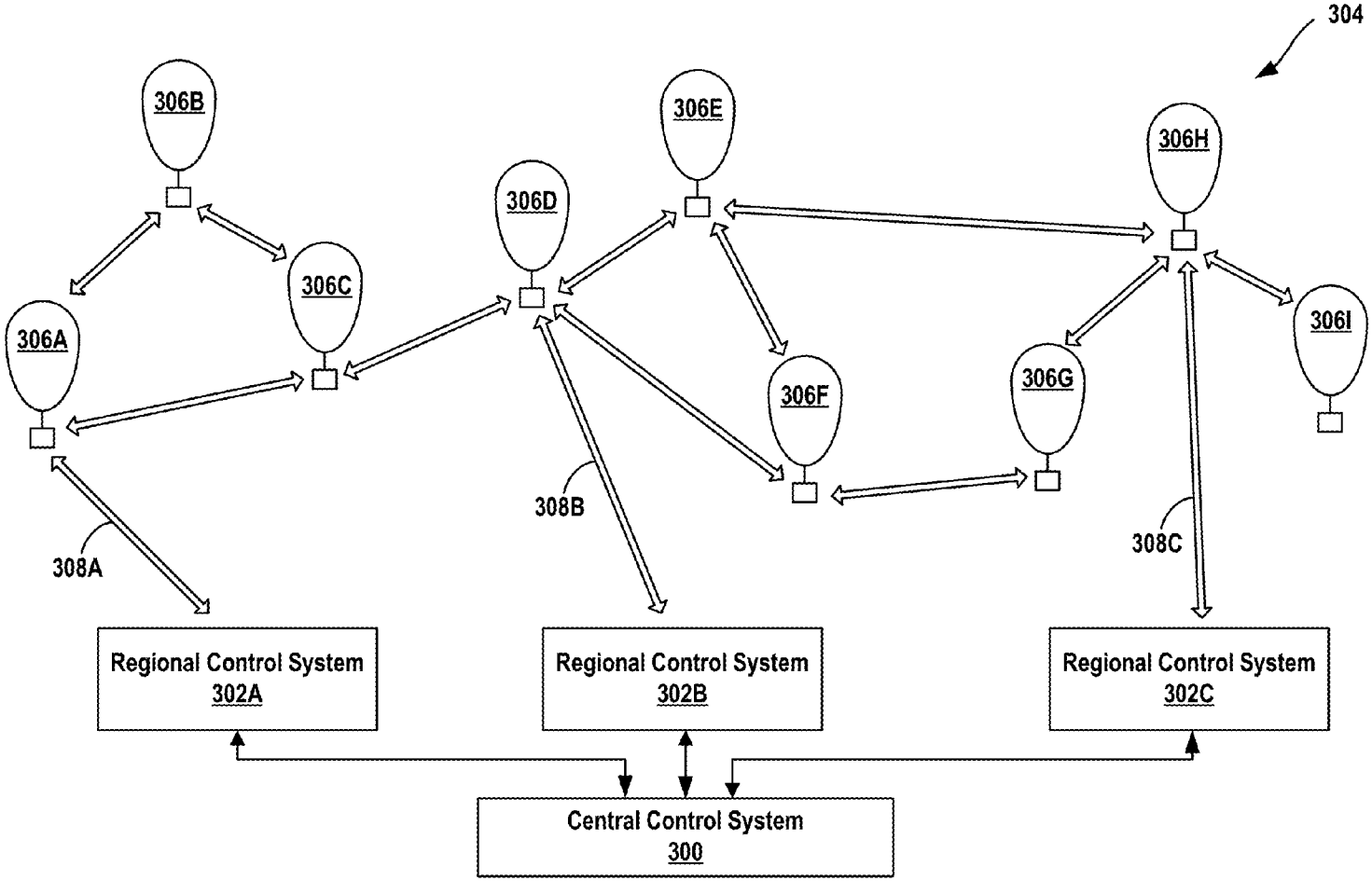
FIG. 3 illustrates a centralized system for controlling a balloon network, according to an embodiment.

Mesh networking, station-keeping functions, or both can be centralized. For example, FIG. 3 illustrates a centralized system for controlling a balloon network 304. In particular, a central control system 300 is in communication with regional control-systems 302A-302C. The central control system 300 can be configured to coordinate functionality of the balloon network 304. To this end, the central control system 300 can control functions of balloons 306A to 306I.

The central control system 300 can communicate with the balloons 306A-306I by way of the regional control systems 302A-302C. Each of the regional control systems 302A-302C can be a ground-based station, such as, for example, the ground-based station 206 discussed above in connection with FIG. 2. Each of the regional control systems 302A-302C can cover a different geographic area. The geographic areas can overlap or be separate. Each of the regional control systems 302A-302C can receive communications from balloons in the respective regional control system's area. In addition, each of the regional control systems 302A-302C can aggregate data from balloons in the respective regional control system's area. The regional control systems 302A-302C can send information they receive to the central control system 300. Further, the regional control systems 302A-302C can route communications from the central control system 300 to the balloons 306A-306I in their respective geographic areas. For instance, the regional control system 302A can relay communications between the balloons 306A-306C and the central control system 300. Likewise, the regional control system 302B can relay communications between the balloons 306D-306F and the central control system 300. Likewise, the regional control system 302C can relay communications between the balloons 306G-306I and the central control system 300.

To facilitate communications between the central control system 300 and the balloons 306A-306I, some of the balloons 306A-306I can serve as downlink balloons. The downlink balloons can communicate with the regional control systems 302A-302C. Accordingly, each of the regional control systems 302A-302C can communicate with a downlink balloon in the geographic area that the regional control system covers. In the balloon network 304, the balloons 306A, 306D, and 306H serve as downlink balloons. The regional control system 302A can communicate with the downlink balloon 306A by way of communication link 308A. Likewise, the regional control system 302B can communicate with the downlink balloon 306D by way of communication link 308B. Likewise, the regional control system 302C can communicate with the balloon 306H by way of communication link 308C. The communication links 308A-308C can be optical links or RF links, depending on the desired implementation.

In the balloon network 304, three of the balloons serve as downlink balloons. In an implementation, all of the balloons in a balloon network can serve as downlink balloons. In another implementation, fewer than three balloons or more than three balloons in a balloon network can serve as downlink balloons.

The central control system 300 can coordinate mesh-networking functions of the balloon network 304. For example, the balloons 306A-306I can send the central control system 300 state information. The central control system 300 can utilize the state information to determine the state of the balloon network 304. State information from a given balloon can include data such as, for example, location data identifying the relative or absolute location of the balloon. In addition, the state information from the given balloon can include data representing wind speeds near the balloon. In addition, the state information from the given balloon can include information about an optical link that the balloon has established. For example, the information about the optical link can include the identity of other balloons with which the balloon has established an optical link, the bandwidth of the optical link, wavelength usage, or availability on an optical link. Accordingly, the central control system 300 can aggregate state information from some or all of the balloons 306A-306I in order to determine an overall state of the balloon network 304.

The overall state of the balloon network 304 can be used to coordinate mesh-networking functions, such as, for example, determining lightpaths for connections. For example, the central control system 300 can determine a current topology based on the aggregate state information from some or all of the balloons 306A-306I. The topology can indicate which optical links are available in the balloon network 304. In addition, the topology can indicate which wavelengths are available for use with the links. The central control system 300 can send the topology to some or all of the balloons 306A-306I so that a routing technique can be employed to select appropriate lightpaths (and possibly backup lightpaths) for communications that use the balloon network 304.

In addition, the central control system 300 can coordinate station-keeping functions of the balloon network 304. For example, the central control system 300 can receive state information from the balloons 306A-306I, as discussed above, and can use the state information as an input to an energy function. The energy function can compare the current topology of the network to a desired topology and, based on the comparison, provide a vector indicating a direction of movement (if any) of each balloon. Further, the central control system 300 can use altitudinal wind data to determine respective altitude adjustments that can be initiated in order to achieve the movement towards the desired topology.

Accordingly, the arrangement shown in FIG. 3 provides for coordinating communications between the central control system 300 and the balloon network 304. This arrangement can be useful to provide centralized control for a balloon network that covers a large geographic area. When expanded, this arrangement can support a global balloon network, which can provide global coverage.

This disclosure contemplates arrangements other than the arrangement shown in FIG. 3. For example, an arrangement can include a centralized control system, regional control systems, and sub-region systems. The sub-region systems can serve to provide communications between the centralized control system and the corresponding regional control systems. As another example, control functions of a balloon network can be provided by a single, centralized, control system. The control system can communicate directly with one or more downlink balloons.

The central control system 300 and the regional control systems 302A-302C need not control and coordinate all of the functions of the balloon network 304. In an implementation, a ground-based control system and a balloon network can share control and coordination of the balloon network. In another implementation, the balloon network itself can control and coordinate all of the functions of the balloon network. Accordingly, in this implementation, the balloon network can be controlled without a need for ground-based control. To this end, certain balloons can be configured to provide the same or similar functions as those discussed above in connection with the central control system 300 and the regional control systems 302A-302C.

In addition, control of a balloon network, coordination of the balloon network, or both can be de-centralized. For example, each balloon in a balloon network can exchange state information with nearby balloons. When the balloons exchange state information in this way, each balloon can individually determine the state of the network. As another example, certain balloons in a balloon network can serve as aggregator balloons. The aggregator balloons can aggregate state information for a given portion of the balloon network. The aggregator balloons can coordinate with one another to determine the overall state of the network.

Control of a balloon network can be localized in a way that the control does not depend on the overall state of the network. For example, balloons in a balloon network can implement station-keeping functions that only consider nearby balloons. In particular, each balloon can implement an energy function that takes into account the balloon's own state and the states of nearby balloons. The energy function can be used to maintain the balloon at a desired position or to move the balloon to a desired position in relation to nearby balloons, without considering the desired topology of the balloon network as a whole. When each balloon in the balloon network implements an energy function in this way, the balloon network as a whole can maintain a desired topology or move towards a desired topology.

For example, assume that a given balloon $B_0$ receives distance information $d_1$, $d_2$, $d_3$, . . . , $d_k$. The distance information $d_1$ represents the distance from the balloon $B_0$ to its neighboring balloon $B_1$. Likewise, the distance information $d_2$ represents a distance from the balloon $B_0$ to its neighboring balloon $B_2$, the distance $d_3$ represents a distance from the balloon $B_0$ to its neighboring balloon $B_3$, and the distance $d_k$ represents a distance from the balloon $B_0$ to its neighboring balloon $B_k$. Accordingly, the distance information represents distances from the balloon to its k closest neighbors. The balloon $B_0$ can treat the distance to each of the k balloons as a virtual spring with vector representing a force direction from the first nearest neighbor balloon i toward balloon $B_0$ and with force magnitude proportional to $d_i$. The balloon $B_0$ can sum each of the k vectors to obtain a summed vector that represents desired movement of the balloon $B_0$. The balloon $B_0$ can attempt to achieve the desired movement by controlling its altitude, as discussed above. This is but one technique for assigning force magnitudes; this disclosure contemplates that other techniques can also be used.

D. Balloon Network with Optical and RF Links Between Balloons

Figure 4:
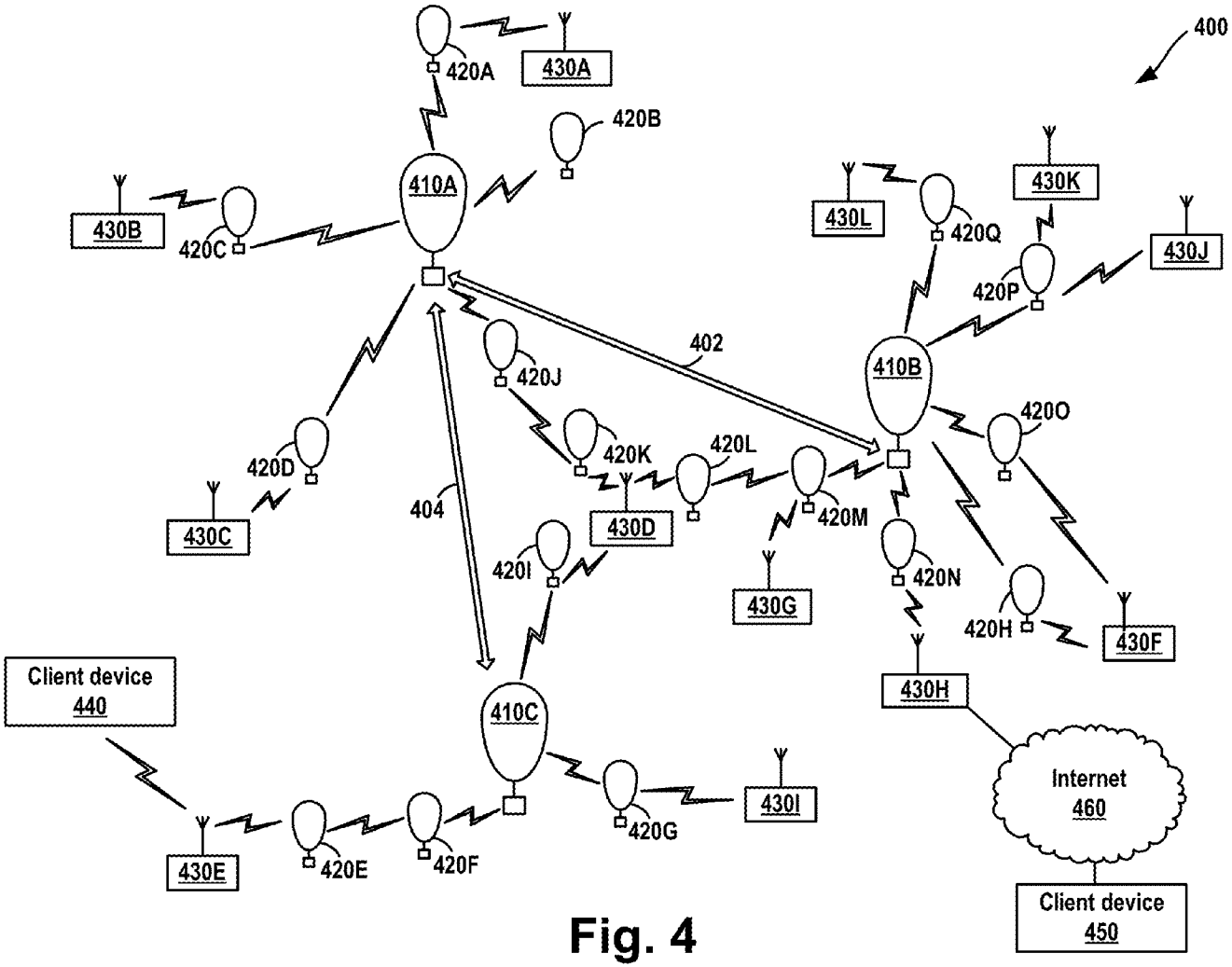
FIG. 4 illustrates a balloon network that includes super-nodes and sub-nodes, according to an embodiment.

A balloon network can include super-node balloons (or simply "super nodes") and sub-node balloons (or simply "sub-nodes"). The super-nodes can communicate with one another by way of optical links. The sub-nodes can communicate with super-nodes by way of RF links. FIG. 4 illustrates a balloon network 400 that includes super-nodes 410A-410C and sub-nodes 420A-420Q, according to an embodiment.

Each of the super-nodes 410A-410C can be provided with a free-space optical communication system that is operable for packet-data communication with other super-node balloons. Accordingly, super-nodes can communicate with one another by way of optical links. For example, the super-node 410A and the super-node 410B can communicate with one another by way of an optical link 402. Likewise, the super-node 410A and the super-node 410C can communicate by way of an optical link 404.

Each of the sub-nodes 420A-420Q can be provided with a radio-frequency (RF) communication system that is operable for packet-data communication over an RF air interface. In addition, some or all of the super-nodes 410A-410C can include an RF communication system that is operable to route packet data to one or more of the sub-nodes 420A-420Q. For example, when the sub-node 420A receives data from the super-node 410A by way of an RF link, the sub-node 420A can use its RF communication system to transmit the received data to a ground-based station 430A by way of an RF link.

In an embodiment, all of the sub-node balloons 420A-420Q can be configured to establish RF links with ground-based stations. For example, all of the sub-nodes 420A-420Q can be configured similarly to the sub-node 420A, which is operable to relay communications between the super-node 410A and the ground-based station 430A by way of respective RF links.

In an embodiment, some or all of the sub-nodes 420A-420Q can be configured to establish RF links with other sub-nodes. For example, the sub-node 420F is operable to relay communications between the super-node 410C and the sub-node 420E. In this embodiment, two or more sub-nodes can provide a multi-hop path between a super-node and a ground-based station. For example, a multi-hop path is provided between the super-node 410C and the ground-based station 430E by way of the sub-node balloons 420E and 420F.

Note that an RF link can be a directional link between a given entity and one or more other entities, or an RF link can be part of an omni-directional broadcast. In the case of an RF broadcast, one or more "links" can be provided by way of a single broadcast. For example, the super-node 410A can establish a separate RF link with each of the sub-nodes 420A-420C. Instead, the super-node 410A can broadcast a single RF signal that can be received by the sub-nodes 420A, 420B, and 420C. The single RF broadcast can in effect provide all of the RF links between the super-node balloon 410A and the sub-node balloons 420A-420C.

Some or all of the super-nodes 410A-410C can serve as downlink balloons. In addition, the balloon network 420 can be implemented without the use of any of the sub-nodes 420A-420Q. In addition, in an embodiment, the super-nodes 410A-410C can collectively function as a core network (or, in other words, as a backbone network), while the sub-nodes 420A-420Q can function as access networks to the core network. In this embodiment, some or all of the sub-nodes 420A-420Q can function as gateways to the balloon network 400. Note that some or all of the ground-based stations 430A-430L can also, or instead, function as gateways to the balloon network 400.

The network topology of the balloon network 400 is but one of many possible network topologies. Further, the network topology of the balloon network 400 can vary dynamically, as super-nodes and sub-nodes move relative to the ground, relative to one another, or both.

IV. A Hybrid Patch and Monopole Antenna

The hybrid patch and monopole antenna disclosed herein may be used on a balloon, on a ground-based receiving device, or both. In some examples, the geometry of the hybrid antenna may be different depending on the embodiment. However, the general structure of the antenna may be similar to that described. In one example embodiment, the hybrid antennas may be configured to communicate between a balloon-based device and a ground-based device over a wireless link having a frequency between 2.5 and 2.7 gigahertz (GHz). The hybrid antenna may also have a fractional bandwidth of approximately 10% and an isolation of at least 20 decibels (dB) at the operating frequency. The antennas of the present disclosure may be adapted for use with other frequencies as well. One skilled in the art would understand how to scale the antennas to other frequencies.

Figure 5:
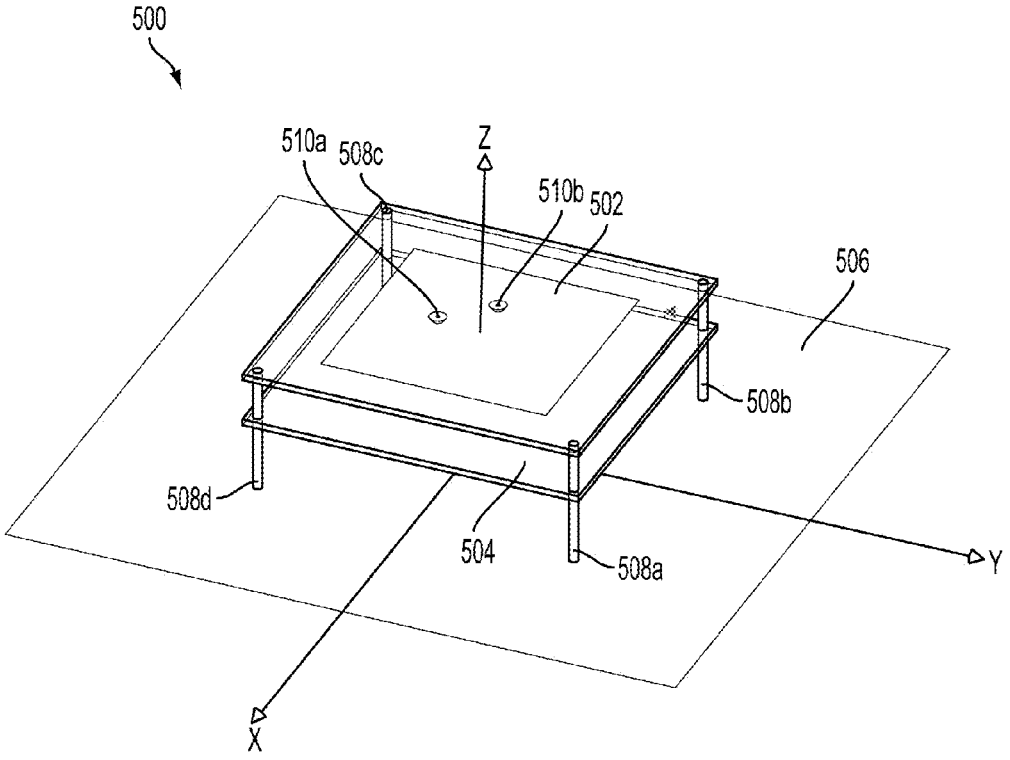
FIG. 5 illustrates an isometric view of a hybrid patch and monopole antenna for radiation pattern control.

FIG. 5 illustrates an isometric view of an example hybrid patch and monopole antenna 500 for radiation pattern control. The patch antenna 502 may be mounted on a substrate located above a ground plane 504. Both the patch antenna 502 and the ground plane 504 may be located above a metallic reflecting element 506. In the example shown in FIG. 5, the antenna 500 includes four monopole antennas 508*a*-508*d* that support both the patch antenna 502 and the ground plane 504 above the reflecting element 506. Additionally, the four monopole antennas 508*a*-508*d* provide a separation between the patch antenna 502 and the ground plane 504, and also between the ground plane 504 and the reflecting element 506. Additionally, the example antenna 500 has two feeds 510*a* and 510*b*.

Figure 6:
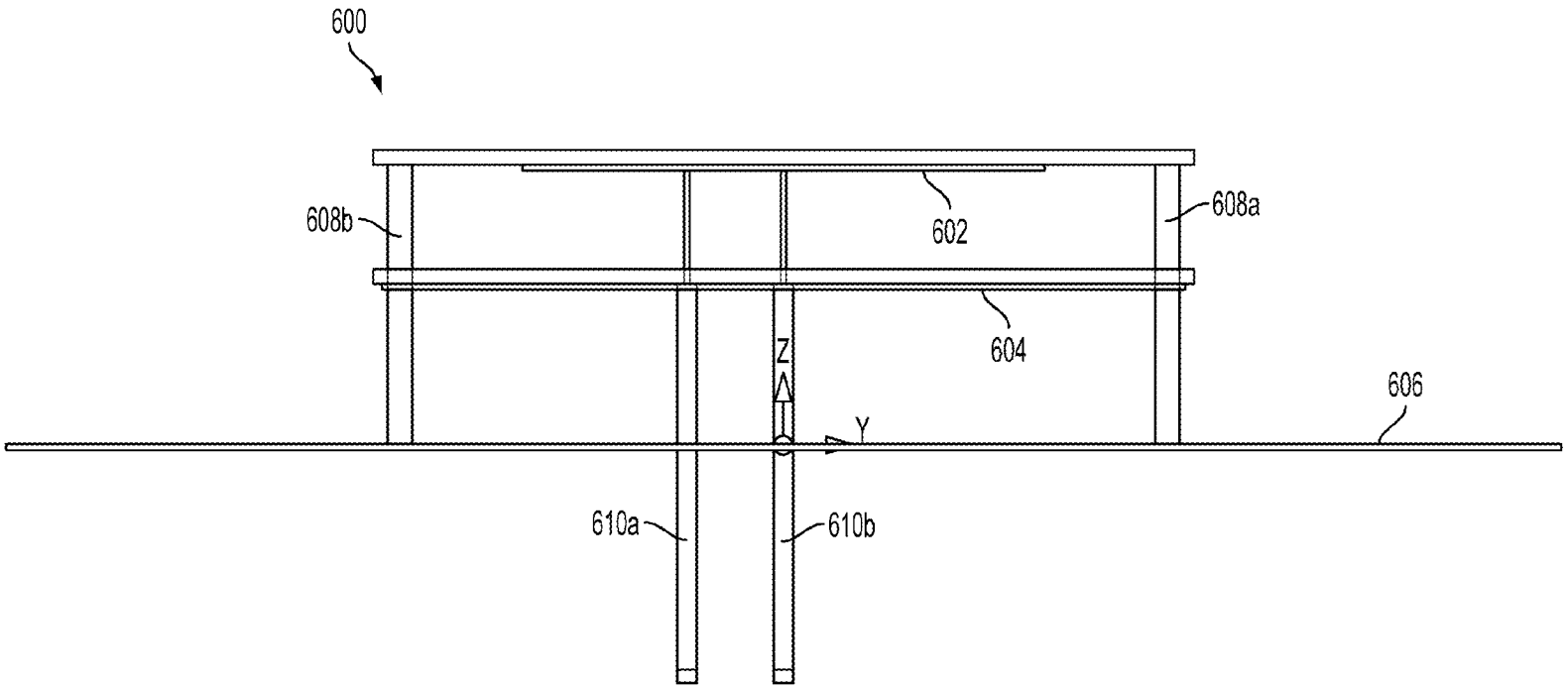
FIG. 6 illustrates a side view of a hybrid patch and monopole antenna for radiation pattern control.

FIG. 6 illustrates a side view of an example hybrid patch and monopole antenna 600 for radiation pattern control. The hybrid patch and monopole antenna 600 of FIG. 6 may be similar to the hybrid patch and monopole antenna 500 of FIG. 5. In the example shown in FIG. 6, the antenna 600 includes four monopole antennas, two of which can be seen as 608*a* and 608*b*, which support both the patch antenna 602 and the ground plane 604 above the reflecting element 606. As seen in the side view, both of the patch antenna 602 and the ground plane 604 are mounted to a substrate. Additionally, the monopole antennas 608*a*-608*b* provide a separation between the patch antenna 602 and the ground plane 604, and also between the ground plane 604 and the reflecting element 606. Additionally, the example antenna 600 has two feeds 610*a* and 610*b*.

Figure 7:
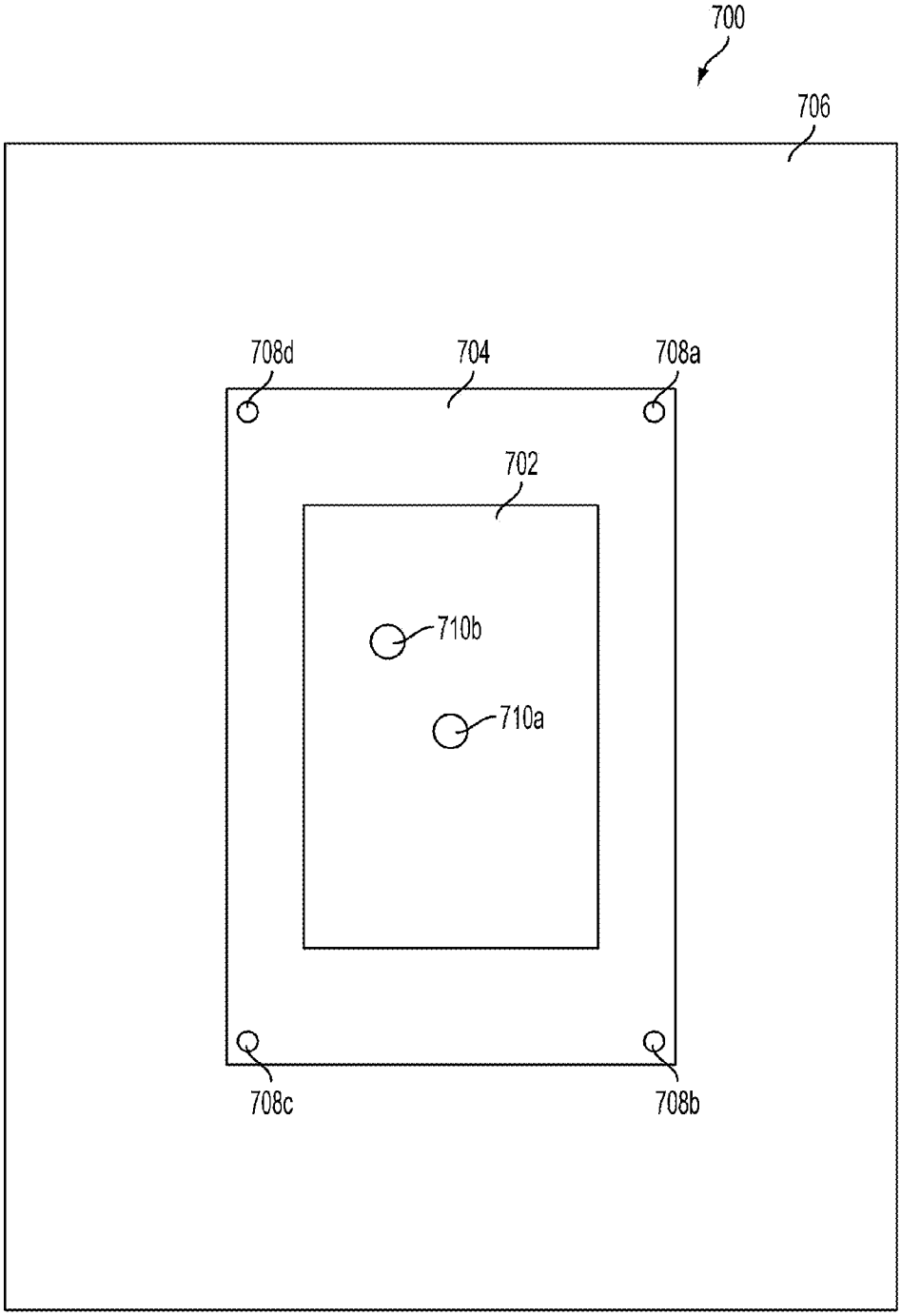
FIG. 7 illustrates a top view of a hybrid patch and monopole antenna for radiation pattern control.

FIG. 7 illustrates a top view of an example hybrid patch and monopole antenna 700 for radiation pattern control. The hybrid patch and monopole antenna 700 of FIG. 7 may be similar to the hybrid patch and monopole antenna(s) of FIGS. 5 and 6. The patch antenna 702 may be mounted on a substrate located above a ground plane 704. Both the patch antenna 702 and the ground plane 704 may be located above a metallic reflecting element 706. In the example shown in FIG. 7, the antenna 700 includes four monopole antennas 708*a*-708*d* that support both the patch antenna 702 and the ground plane 704 above the reflecting element 706. Additionally, the four monopole antennas 708*a*-708*d* provide a separation (not shown in the top view) between the patch antenna 702 and the ground plane 704, and also between the ground plane 704 and the reflecting element 706. Additionally, the example antenna 700 has two feeds 710*a* and 710*b*.

The various views of the example hybrid patch and monopole antennas shown in FIGS. 5-7 show example geometries for use with disclosed embodiments. The size, shape, and location of the various elements of the hybrid patch and monopole antenna may be adjusted based on design criteria of a specific antenna. For example, changing the monopole length may adjust the amount of electromagnetic energy that couples into the monopole antennas. Thus, the resulting radiation pattern may change based on the length of the monopole antennas. Additionally, the distance between the monopoles and the patch antenna may be adjusted as well. Further examples will be discussed below.

In one example of a balloon-based antenna, the reflecting element may have a length of 120 millimeters (mm). The monopole antennas may be spaced 63.5 mm apart from each other (i.e. the distance from one monopole to another monopole at an adjacent corner). Additionally, the patch antenna may be spaced 22.5 mm above the reflecting element. In one example of a ground-based antenna, the reflecting element may have a length of 120 millimeters (mm). The monopole antennas may be spaced 65 mm apart from each other (i.e. the distance from one monopole to another monopole at an adjacent corner). Additionally, in the balloon-based system, the patch antenna may be spaced 22.5 mm above the reflecting element. In addition, the ground plane may be spaced 12.5 mm above the reflecting element and the monopole antennas may be located 42 mm from the center of the patch. Further, in the ground-based system, the patch antenna may be spaced 22.8 mm above the reflecting element. In addition, the ground plane may be spaced 12.5 mm above the reflecting element and the monopole antennas may be located 43 mm from the center of the patch.

Figure 8B:
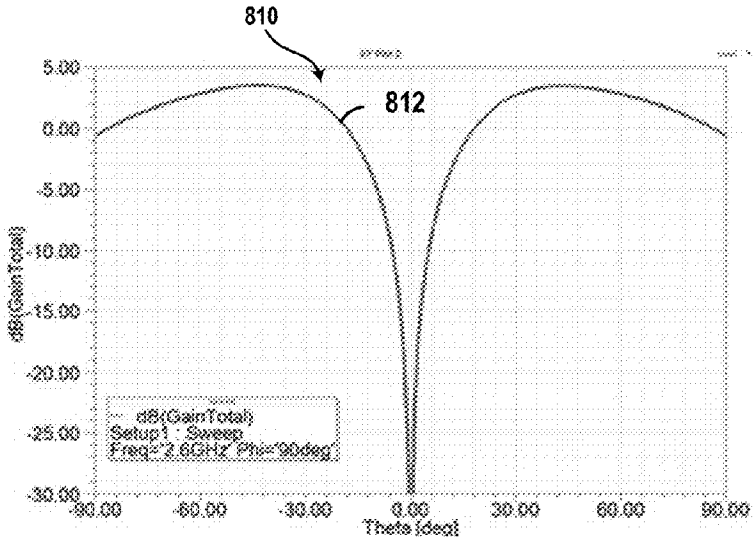
FIG. 8B illustrates an example radiation pattern for an example monopole antenna.
Figure 8A:
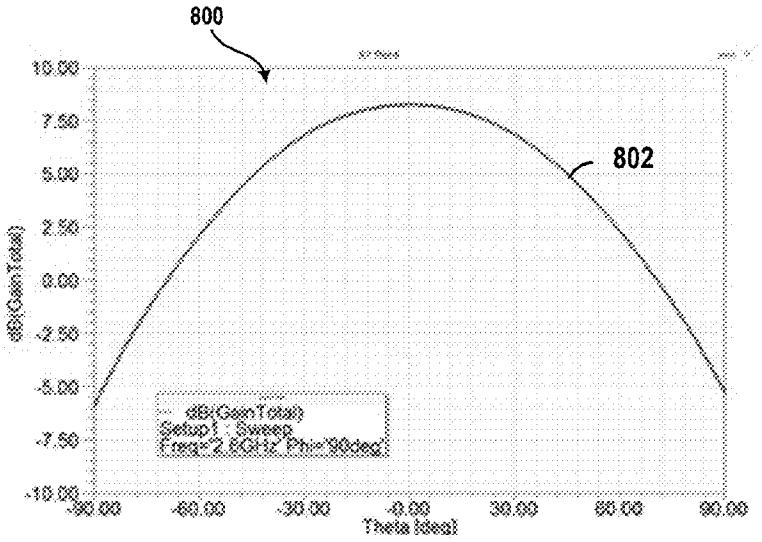
FIG. 8A illustrates an example radiation pattern for an example patch antenna.

FIG. 8A illustrates an example radiation pattern for an example patch antenna. A patch antenna—such as patch antenna 502 of FIG. 5—may have a radiation pattern similar to that shown in FIG. 8A. For example, a patch antenna may have a maximum in a direction normal to the surface of the patch (i.e. when theta is equal to 0 degrees). The gain of the patch antenna may decrease as the angle moves away from the normal direction.

FIG. 8B illustrates an example radiation pattern for an example monopole antenna. A monopole antenna—such as monopole antenna(s) 508*a*-508*d* of FIG. 5—may have a radiation pattern similar to that shown in FIG. 8B. For example, a monopole antenna may have a minimum in a direction along to the length of the monopole (i.e. when theta is equal to 0 degrees). Due to the example monopole antennas being located near the reflecting element (506 of FIG. 5) and supporting the antenna structure, the maximum of the monopole antenna radiation pattern may be at approximately when theta is equal to ±45 degrees. In other examples, the maximum of the monopole antenna may be at angles other than ±45 degrees.

Figure 8C:
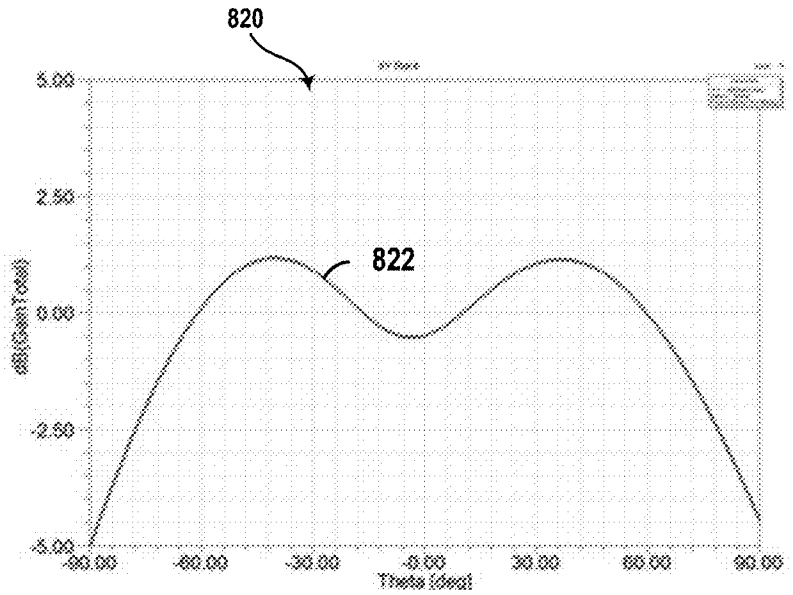
FIG. 8C illustrates an example radiation pattern for an example hybrid patch and monopole antenna.

FIG. 8C illustrates an example radiation pattern for an example hybrid patch and monopole antenna. A hybrid patch and monopole antenna, such as monopole antenna 500 of FIG. 5 may have a radiation pattern similar to that shown in FIG. 8C. For example, a the hybrid antenna may have a relative minimum in a direction normal to the surface of the patch antenna (i.e. when theta is equal to 0 degrees) and a maximum of the antenna radiation pattern may be at approximately when theta is equal to ±45 degrees. In other examples, the maximum of the hybrid antenna may be at angles other than ±45 degrees. In this example, the maximum and relative minimum may be selected in a way to offset for the increase in distance (and thus, weaker received signal) between the balloon and the ground-based antenna as the balloon changes angle with respect to the ground-based antenna.

To operate the antennas a method of radiating electromagnetic energy from the hybrid antenna may be used. The signal to be radiated by the antenna may be fed as a first input signal to a first radiating element, such as the patch antenna. When the first input signal is fed to the patch antenna, an electromagnetic field may be generated on the surface of the patch antenna. In some embodiments, the patch antenna may have two feeds. Both feeds may supply a signal to the patch antenna at the same time (or at different times). By feeding two signals to the antenna, the patch antenna may transmit with polarization diversity. By having polarization diversity, the hybrid antenna may be able to minimize effects of polarization mismatch of signals.

The hybrid antenna may then radiate a signal based on at least a portion of the input signal by the first radiating element. The electromagnetic field generated on the surface of the patch antenna may cause at least a portion of the electromagnetic energy on the patch to radiate away from the patch (i.e. propagate an electromagnetic wave in free space).

The patch antenna may be supported via metallic support structures above a reflecting element with at least one metallic support structure. In some embodiments, the metallic support structures may take the form of four monopole antennas that are spaced near the edges of a substrate that the patch antenna is mounted on. The metallic support structure(s) is configured to couple some of the radiated electromagnetic energy from the first radiating element (i.e. patch antenna) and radiate at least a portion of the coupled energy (i.e. the metallic support structure(s) may reradiate some of the electromagnetic signal that was radiated initially by the patch antenna). The reflecting element may be configured to reflect a portion of at least one of (i) the signal radiated by the first radiating element, and (ii) electromagnetic energy radiating by the at least one metallic support structure.

The first radiating element may be configured to radiate based on a first radiation pattern. For example, a patch antenna may be configured to radiate with a maximum normal to the surface of the patch. The at least one metallic support structure may be configured to radiate based on a second radiation pattern. The second radiation pattern may have a minimum in a direction along to the length of the metallic support structure. While in the hybrid antenna configuration, a maximum of the first radiation pattern is substantially aligned to a minimum of the second radiation pattern. The overall radiation pattern of the hybrid antenna system is based on a combination of the first radiation pattern and the second radiation pattern. In some embodiments, the system radiation pattern is configured to have maximums at ±45 degrees from a normal direction to a plane of the first radiating element.

The system radiation pattern may be chosen so that a received signal strength of a signal between the balloon and the ground-based receiving device remains approximately constant across a range of angles. As a balloon moves across the sky, it may be closest to the ground-based receiving device when the balloon is directly overhead to the ground-based receiving device. The balloon being directly overhead the ground-based receiving device may align the balloon with the maximum of the patch's radiation pattern and the minimum of the monopoles' radiation pattern. When the balloon is not directly overhead to the ground-based receiving device, the balloon is further away from the ground-based receiving device, and in turn the ground-based receiving device is in a position to receive a weaker signal. However, by having a system radiation pattern that has a maximum corresponding to an angle when the balloon is not directly above the ground-based receiving device, the radiation pattern can compensate for the weaker signal. Therefore, the ground-based receiving device may receive approximately the same signal level over a wide range of angles.

As disclosed herein is an antenna system for use between two devices that may have a movement relative to one another, for example a ground-based computing system in communication with a balloon-based device. The antenna system may combine (i) a patch antenna that is actively driven by an electromagnetic signal and (ii) parasitic monopole antenna(s) that may be passively driven by a coupling of the signal radiated by the patch antenna to the monopole antenna(s). The monopole antenna(s) may also be configured to support the patch antenna (or substrate to which the patch is mounted) above at least one of a ground plane and a reflecting element. Thus, the monopole antenna(s) function both as electrical elements and mechanical support elements of the antenna system. By having an electromagnetic signal radiated by both the patch antenna and the monopole antenna(s), the radiation patterns of the various antenna elements combines to form the system radiation pattern. This combined system radiation pattern may have a wider range of angles over which communication my be possible compared to either antenna element by itself.

V. Computing Device and Computer Program Product

Figure 9:
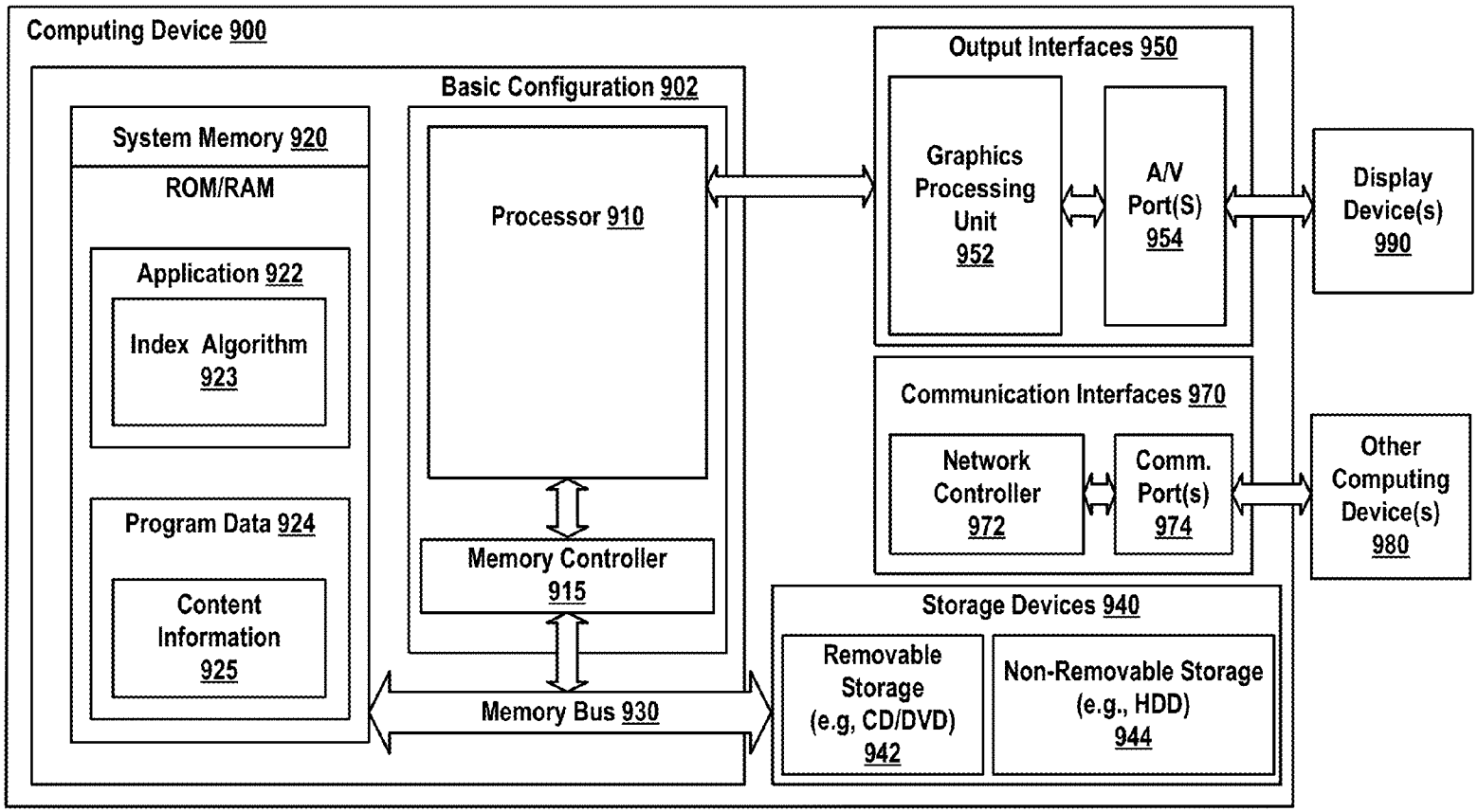
FIG. 9 illustrates a functional block diagram of a computing device, according to an embodiment.

FIG. 9 illustrates a functional block diagram of a computing device 900, according to an embodiment. The computing device 900 can be used to perform functions in connection with the operation of a balloon network. In particular, the computing device can be used to perform some or all of the functions discussed above in connection with FIGS. 1-6.

The computing device 900 can be or include various types of devices, such as, for example, a server, personal computer, mobile device, cellular phone, custom computing device, or tablet computer. In a basic configuration 902, the computing device 900 can include one or more processors 910 and system memory 920. A memory bus 930 can be used for communicating between the processor 910 and the system memory 920. Depending on the desired configuration, the processor 910 can be of any type, including a microprocessor (μP), a microcontroller (μC), or a digital signal processor (DSP), among others. A memory controller 915 can also be used with the processor 910, or in some implementations, the memory controller 915 can be an internal part of the processor 910.

Depending on the desired configuration, the system memory 920 can be of any type, including volatile memory (such as RAM) and non-volatile memory (such as ROM, flash memory). The system memory 920 can include one or more applications 922 and program data 924. The application(s) 922 can include an index algorithm 923 that is arranged to provide inputs to the electronic circuits. The program data 924 can include content information 925 that can be directed to any number of types of data. The application 922 can be arranged to operate with the program data 924 on an operating system.

The computing device 900 can have additional features or functionality, and additional interfaces to facilitate communication between the basic configuration 902 and any devices and interfaces. For example, data storage devices 940 can be provided including removable storage devices 942, non-removable storage devices 944, or both. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives. Computer storage media can include volatile and nonvolatile, non-transitory, removable and non-removable media implemented in any method or technology for storage of information, such as computer readable instructions, data structures, program modules, or other data.

The system memory 920 and the storage devices 940 are examples of computer storage media. Computer storage media includes, but is not limited to, RAM, ROM, EEPROM, flash memory or other memory technology, CD-ROM, DVDs or other optical storage, magnetic cassettes, magnetic tape, magnetic disk storage or other magnetic storage devices, or any other medium that can be used to store the desired information and that can be accessed by the computing device 900.

The computing device 900 can also include output interfaces 950 that can include a graphics processing unit 952, which can be configured to communicate with various external devices, such as display devices 990 or speakers by way of one or more A/V ports or a communication interface 970. The communication interface 970 can include a network controller 972, which can be arranged to facilitate communication with one or more other computing devices 980 over a network communication by way of one or more communication ports 974. The communication connection is one example of a communication media. Communication media can be embodied by computer-readable instructions, data structures, program modules, or other data in a modulated data signal, such as a carrier wave or other transport mechanism, and includes any information delivery media. A modulated data signal can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR), and other wireless media.

The computing device 900 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. The computing device 900 can also be implemented as a personal computer including both laptop computer and non-laptop computer configurations.

Figure 10:
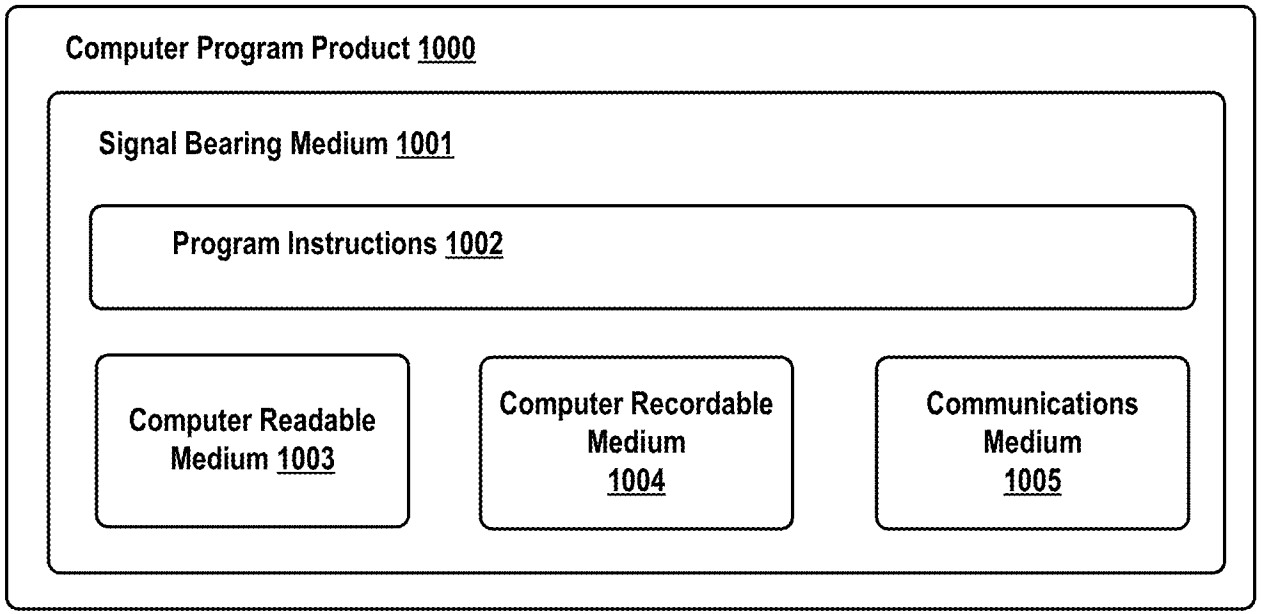
FIG. 10 illustrates a computer program product, according to an embodiment.

The disclosed methods can be implemented as computer program instructions encoded on a non-transitory computer-readable storage medium in a machine-readable format, or on other non-transitory media or articles of manufacture. FIG. 10 illustrates a computer program product 1000, according to an embodiment. The computer program product 1000 includes a computer program for executing a computer process on a computing device, arranged according to some disclosed implementations.

The computer program product 1000 is provided using a signal bearing medium 1001. The signal bearing medium 1001 can include one or more programming instructions 1002 that, when executed by one or more processors, can provide functionality or portions of the functionality discussed above in connection with FIGS. 1-6. In some implementations, the signal bearing medium 1001 can encompass a computer-readable medium 1003 such as, but not limited to, a hard disk drive, a CD, a DVD, a digital tape, or memory. In some implementations, the signal bearing medium 1001 can encompass a computer-recordable medium 1004 such as, but not limited to, memory, read/write (R/W) CDs, or R/W DVDs. In some implementations, the signal bearing medium 1001 can encompass a communications medium 1005 such as, but not limited to, a digital or analog communication medium (for example, a fiber optic cable, a waveguide, a wired communications link, or a wireless communication link). Thus, for example, the signal bearing medium 1001 can be conveyed by a wireless form of the communications medium 1005 (for example, a wireless communications medium conforming with the IEEE 802.11 standard or other transmission protocol).

The one or more programming instructions 1002 can be, for example, computer executable instructions. A computing device (such as the computing device 900 of FIG. 9) can be configured to provide various operations in response to the programming instructions 1002 conveyed to the computing device by one or more of the computer-readable medium 1003, the computer recordable medium 1004, and the communications medium 1005.

While various examples have been disclosed, other examples will be apparent to those skilled in the art. The disclosed examples are for purposes of illustration and are not intended to be limiting, with the true scope and spirit being indicated by the following claims.

What is claimed is:

1. An antenna system comprising:

a first radiating element configured to emit electromagnetic radiation based on a first input signal, wherein the first radiating element has a first radiation pattern;

a reflecting element configured to reflect at least a portion of the electromagnetic radiation emitted by the first radiating element;

a ground plane located between the first radiating element and the reflecting element;

a feed configured to provide the first input signal to the first radiating element;

at least one metallic support structure configured to:

provide a separation between the first radiating element and the reflecting element;

receive electromagnetic radiation emitted by the first radiating element based on at least a portion of the electromagnetic radiation emitted by the first radiating element coupling to the at least one metallic support structure; and radiate electromagnetic energy based on the received electromagnetic radiation, wherein the at least one metallic support structure has a second radiation pattern, wherein a maximum of the first radiation pattern is substantially aligned to a minimum of the second radiation pattern.

2. The antenna system according to claim 1, wherein the antenna system has a system radiation pattern and the radiation pattern is based on a combination of the first radiation pattern and the second radiation pattern.

3. The antenna system according to claim 2, wherein the system radiation pattern is configured to have maximums at ±45 degrees from a normal direction to a plane of the first radiating element.

4. The antenna system according to claim 1, wherein the at least one metallic support structure comprises four metallic support structures, wherein the metallic support structures are each secured to one of a set of corners of a substrate upon which the first radiating structure is disposed.

5. The antenna system according to claim 1, wherein the first radiating element is a patch antenna.

6. The antenna system according to claim 1, wherein each of the at least one metallic structures is a monopole antenna.

7. The antenna system according to claim 1, wherein the at least one metallic support structure is further configured to provide a separation between the first radiating element and the ground plane.

8. The antenna system according to claim 1, wherein the first radiating element is further configured to emit electromagnetic radiation based on a second input signal.

9. The antenna system according to claim 8, wherein the second input signal is provided by a second feed.

10. The antenna system according to claim 9, wherein the first radiating element is further configured to emit electromagnetic radiation with a polarization diversity based on the first input signal and the second input signal.

11. A method of radiating electromagnetic energy comprising:

feeding a first input signal to a first radiating element;

radiating a signal from the first radiating element based on at least a portion of the input signal, wherein the radiating comprises radiating based on a first radiation pattern;

supporting the first radiating element above a reflecting element with at least one metallic support structure;

receiving, by the at least one metallic support structure, electromagnetic radiation emitted by the first radiating element based on at least a portion of the electromagnetic radiation emitted by the first radiating element coupling to the at least one metallic support structure;

radiating electromagnetic energy with the at least one metallic support structure based on the received electromagnetic radiation, wherein a maximum of the first radiation pattern is substantially aligned to a minimum of the second radiation pattern;

using the reflecting element to reflect a portion of at least one of (i) the signal radiated by the first radiating element, and (ii) electromagnetic energy radiated by the at least one metallic support structure.

12. The method according to claim 11, wherein the antenna system has a system radiation pattern and the radiation pattern is based on a combination of the first radiation pattern and the second radiation pattern.

13. The method according to claim 12, wherein the system radiation pattern is configured to have maximums at ±45 degrees from a normal direction to a plane of the first radiating element.

14. The method according to claim 11, wherein the at least one metallic support structure comprises four metallic support structures.

15. The method according to claim 11, wherein the first radiating element is a patch antenna and wherein each of the at least one metallic support structure is a monopole antenna.

16. The method according to claim 11, wherein the reflecting element is further configured to reflect a portion of both (i) the signal radiated by the first radiating element, and (ii) electromagnetic energy radiated by the at least one metallic support structure.

17. The method according to claim 11, further comprising the at least one metallic structure providing a separation between the first radiating element and a ground plane.

18. The method according to claim 11, wherein the first radiating element is further configured to emit electromagnetic radiation with a polarization diversity based on the first input signal and a second input signal.

* * * * *